US006772451B2

(12) United States Patent
Pellati

(10) Patent No.: US 6,772,451 B2
(45) Date of Patent: Aug. 10, 2004

(54) AUTOMATIC DEVICE FOR WASHING A TOILET SEAT RING

(75) Inventor: Giuseppe Pellati, Fiorano Modenese (IT)

(73) Assignee: Eurosan S.r.L., Fiorano Modenese (IT)

( * ) Notice: Subject to any disclaimer, the term of this patent is extended or adjusted under 35 U.S.C. 154(b) by 0 days.

(21) Appl. No.: 10/232,658

(22) Filed: Sep. 3, 2002

(65) Prior Publication Data

US 2003/0046754 A1 Mar. 13, 2003

(30) Foreign Application Priority Data

Sep. 12, 2001 (IT) ..... MO2001A0180

(51) Int. Cl.[7] ..... A47K 13/00
(52) U.S. Cl. ..... 4/233
(58) Field of Search ..... 4/233, 304, 305, 4/313

(56) References Cited

U.S. PATENT DOCUMENTS 5,022,098 A * 6/1991 Brower ..... 4/233
6,003,159 A * 12/1999 Sadegh et al. ..... 4/233

FOREIGN PATENT DOCUMENTS

| | | | |
|---|---|---|---|
| EP | 0 855 475 | 7/1998 | |
| GB | 2204611 A | * 11/1988 | ..... A47K/13/30 |
| GB | 2 275 060 | 8/1994 | |
| WO | 94 01034 | 1/1994 | |

* cited by examiner

*Primary Examiner*—Tuan N. Nguyen
(74) *Attorney, Agent, or Firm*—Guido Modiano; Albert Josif; Daniel O'Byrne

(57) ABSTRACT

An automatic device for washing a toilet seat ring has a lid divided into two parts, including a lower part fixed to the upper rim of the toilet bowl and on the inner surface of the lower part the toilet seat ring rests, and an upper part superimposed hermetically on the lower part, which can be lifted angularly with respect to the lower part. The upper part has a box-like structure having on the bottom thereof exit holes for a fluid for washing the toilet seat ring and exit openings for air for drying the washed ring, the upper part having ducts for feeding the washing fluid to the holes and channels for feeding air to the openings.

10 Claims, 3 Drawing Sheets

AUTOMATIC DEVICE FOR WASHING A TOILET SEAT RING

BACKGROUND OF THE INVENTION

The present invention relates to an improved automatic device for washing a toilet seat ring.

There are public restrooms, constituted by an enclosed space of limited size inside which the toilet is accommodated, which are provided with a system for the complete automatic washing of the entire lavatory after each use thereof.

These lavatories have a considerably complicated structure, which it must be possible to seal completely during washing, and have disadvantageously high manufacturing costs.

Toilets are also known which have a device that, after every use thereof, replaces the used seat ring with another clean and disinfected one.

This last device, in addition to being bulky and expensive, must be combined with another device for washing the used seat rings.

A toilet is also known in which the ring is covered with a tubular film; after each use of the toilet, a mechanism makes the film slide so that a new section thereof covers the ring.

However, this toilet does not ensure perfect hygiene of the ring, since the film can be affected by damage that hinders its correct sliding and prevents complete covering of the ring.

As an alternative, in order to obviate the above cited drawbacks, devices are known which after each use of the toilet automatically wash and disinfect its seat ring.

These known devices comprise a lid for closing the toilet that is divided into two parts; a lower part, which is fixed to the rim of the toilet bowl and on the inner surface of which the ring rests, and an upper part, which is superimposed hermetically on the lower part and can be lifted angularly with respect to it.

In the upper part of the lid there are channels which have, in a downward region, vertical holes which are initially fed with a disinfectant liquid to wash the ring and are then fed with hot air to dry the washed ring.

After each use of the toilet, the upper part is lowered automatically to perform the washing and drying cycle and then raised at the end of said cycle.

However, even these known devices for automatic washing and disinfection of the toilet seat ring are not free from drawbacks, including the fact that the dispensing of the disinfectant liquid on the part of the vertical holes, which spray said liquid from above onto the ring at right angles thereto, does not allow complete and effective washing of said ring.

Another disadvantage is the fact that the use of the same channels and of the same holes for the alternating dispensing of the disinfectant liquid and of the hot air, due to the residues of liquid that remain inevitably therein, does not allow to dry the ring completely, giving the next user the impression that the ring is not clean or producing, upon contact therewith, an unpleasant feeling of wetness and stickiness.

Another disadvantage of known devices is the fact that they do not allow to wash accurately the area to the rear of the ring, whereat dead zones remain which are not reached by the disinfectant liquid and act as seats of accumulation of dirt and deposits.

Finally, another drawback of known devices is the fact that they require the design and installation of a circuit for the alternating supply of disinfectant liquid and hot air that is structurally and constructively very complicated.

SUMMARY OF THE INVENTION

The aim of the present invention is to eliminate the above noted drawbacks of known devices for automatically washing and disinfecting a toilet seat ring, by providing an improved automatic device for washing a toilet seat ring that allows to optimize both the washing and the drying of the seat ring, to clean completely the dead zones as well, and to simplify the structure and construction of the circuit for feeding the disinfectant liquid and the drying air, improving the efficiency, assembly and maintenance thereof.

Within this technical aim, an object of the present invention is to achieve the above aim with a structure that is simple, relatively easy to provide in practice, safe in use, effective in operation, and relatively modest in cost.

This aim and this object are achieved by the present improved automatic device for washing a toilet seat ring, comprising a lid that is divided into two parts, namely a lower part, which is suitable to be fixed to the upper rim of the toilet bowl and on the inner surface of which the toilet seat ring rests, and an upper part, which is suitable to be superimposed hermetically on said lower part and can be lifted angularly with respect to it, characterized in that said upper part comprises a box-like structure on the bottom of which there are exit holes for a fluid for washing the toilet seat ring and there are exit openings for air for drying the washed ring, said upper part having means for feeding the washing fluid to said holes and means for feeding the air to said openings.

BRIEF DESCRIPTION OF THE DRAWINGS

Further characteristics and advantages of the present invention will become better apparent from the detailed description of a preferred but not exclusive embodiment of an improved automatic device for washing a toilet seat ring, illustrated only by way of non-limitative example in the accompanying drawings, wherein.

DESCRIPTION OF THE PREFERRED EMBODYMENTS

Figure 1:
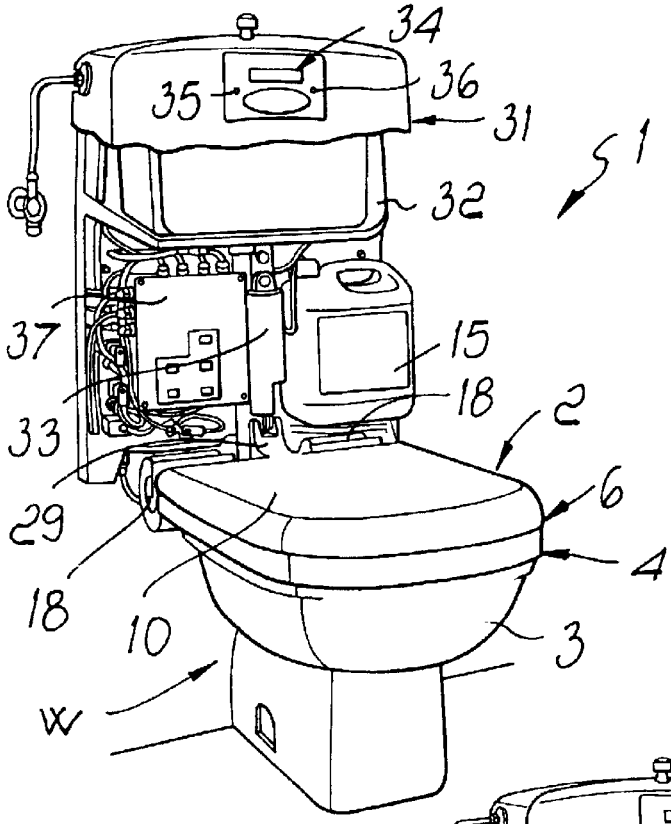
FIG. 1 is a schematic and partially cutout perspective view of a device according to the invention in the configuration for washing the toilet seat ring.
Figure 2:
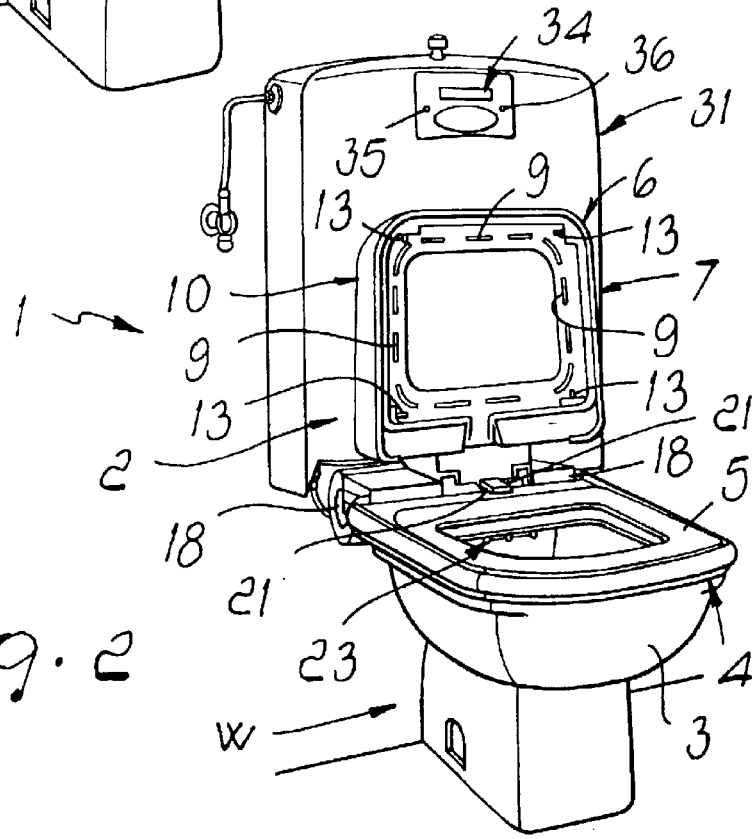
FIG. 2 is a schematic perspective view of the device of FIG. 1 in the configuration for using the toilet.
Figure 3:
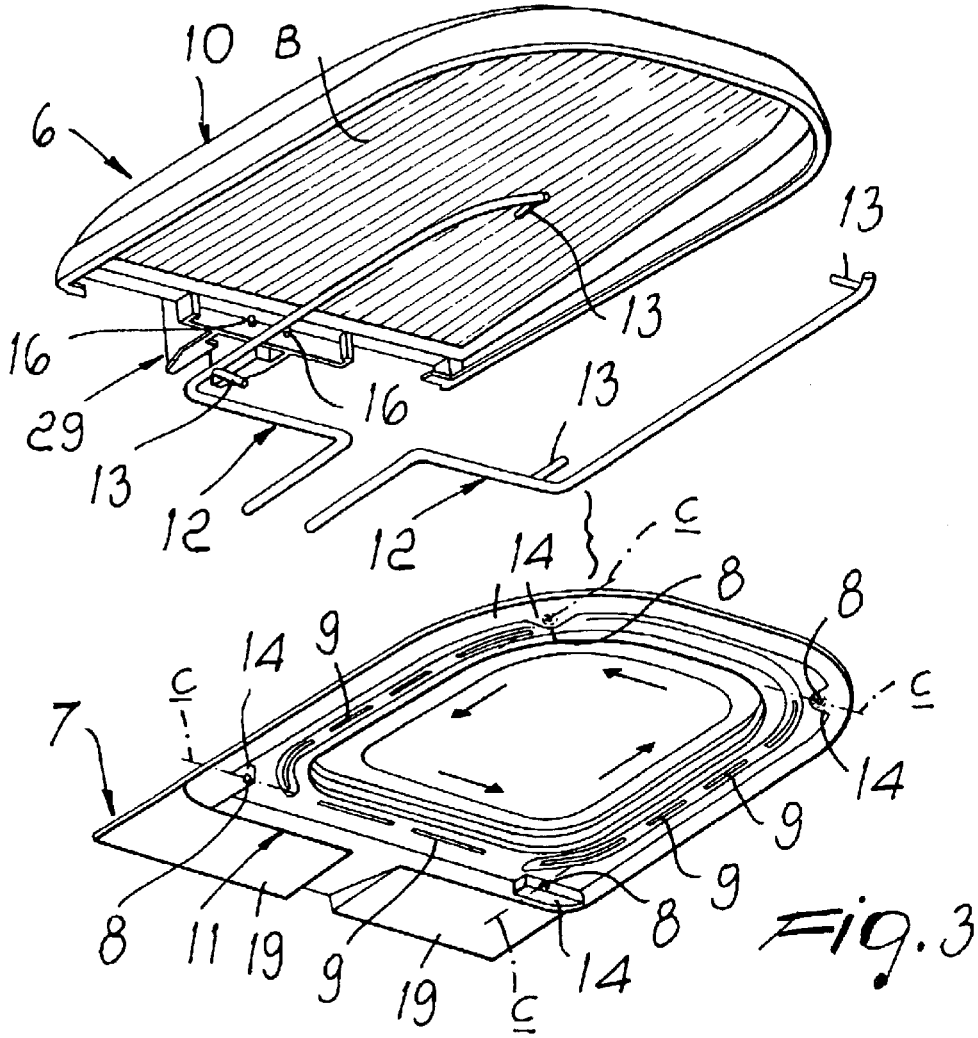
FIG. 3 is a schematic exploded view of the upper part of the lid of the device according to the invention.
Figure 4:
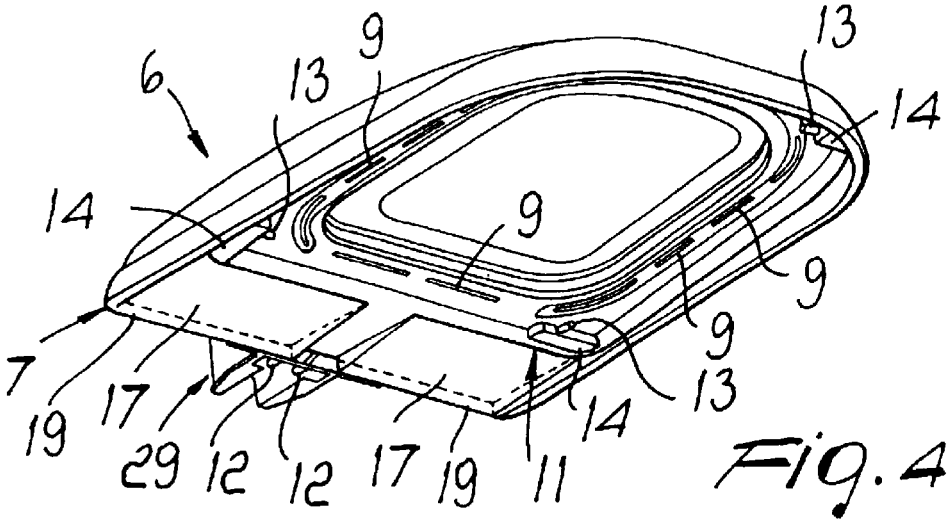
FIG. 4 is a schematic axonometric view of the upper part of the lid of the device according to the invention.
Figure 5:
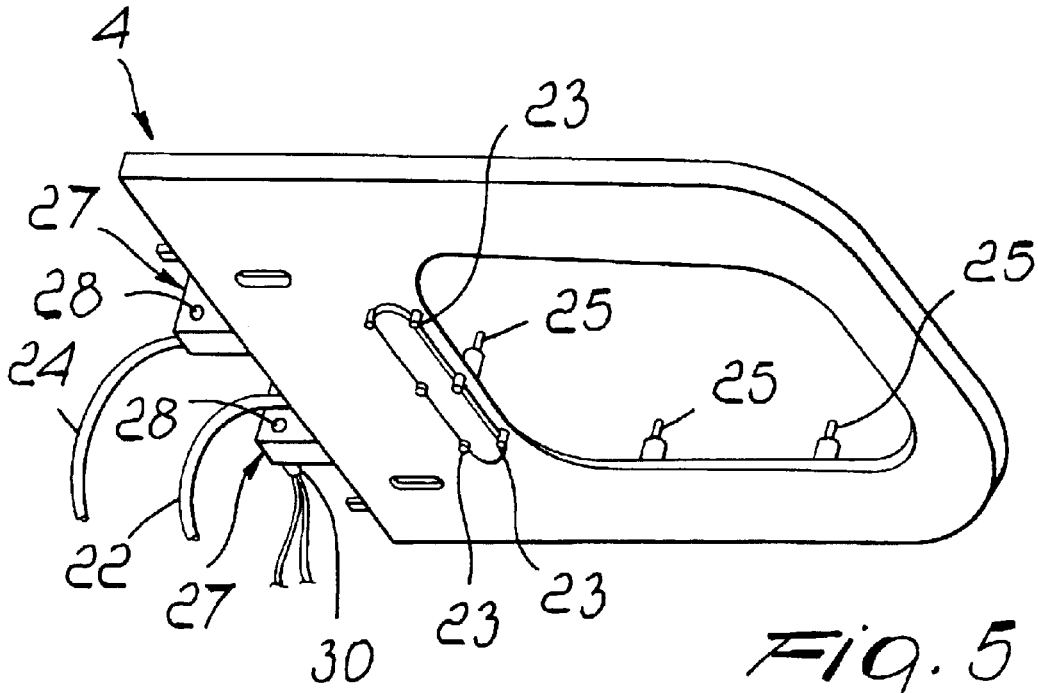
FIG. 5 is a schematic axonometric bottom view of the lower part of the lid of the device according to the invention.
Figure 6:
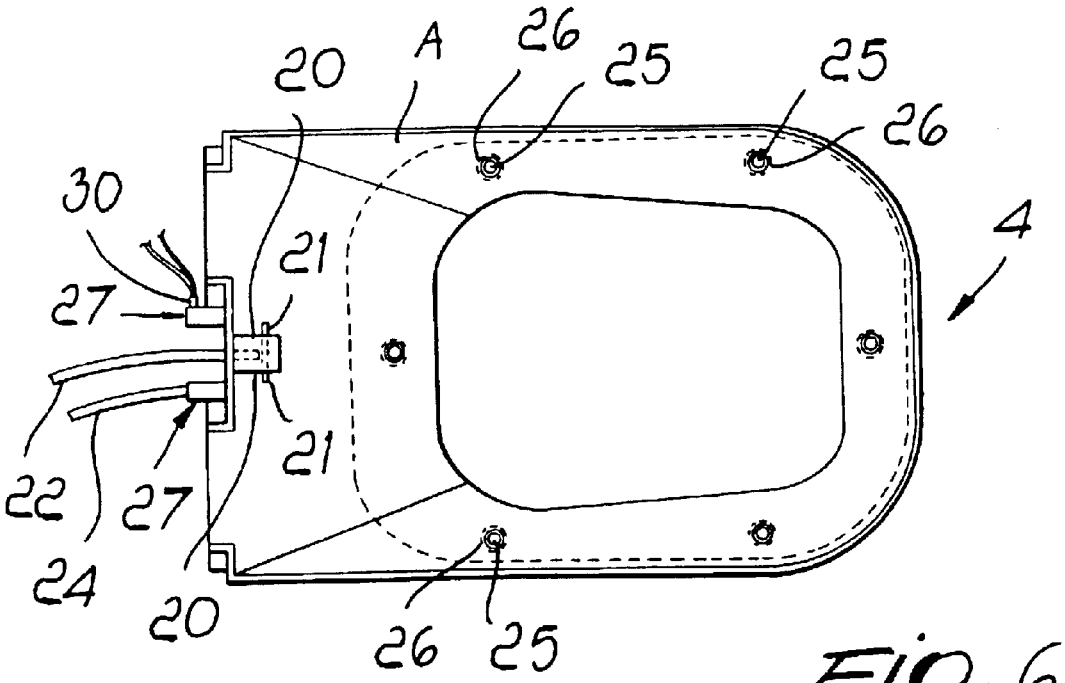
FIG. 6 is a schematic top plan view of FIG. 5.

With particular reference to the above figures, the reference numeral 1 generally designates an automatic device for washing the seat ring of the toilet W.

The device 1 comprises a lid 2 for the upper closure of the bowl 3 of the toilet W, which is divided into two parts: a lower part 4, which is fixed to the upper rim of the bowl 3 and on the inner surface A of which the ring 5 is rested, and an upper part 6, which is suitable to be superimposed hermetically on the lower part 4 and to which it is pivoted at the rear so that it can be lifted angularly with respect to said lower part.

The upper part 6 comprises a box-like structure that is in turn constituted by two bodies that are mutually rigidly coupled: a lower body 7, which is suitable to constitute the bottom of the upper part 6 and is provided with exit holes 8 for a fluid for washing the seat ring 5 and with exit openings 9 for the air for drying the washed seat ring 5, and an upper body 10.

The lower body 7 is substantially plate-like and has a lower annular protrusion 11 at which the holes 8 and the openings 9 are provided; said protrusion is suitable to form, in combination with the inner surface B of the upper body 10, an annular chamber that is not shown.

Said annular chamber acts as a chamber for distributing air to the openings 9.

The upper part 6 furthermore comprises means for feeding the fluid that are constituted by two ducts 12 that are inserted inside it and are fed with the washing fluid and are provided with dispensing nozzles 13, each of which leads out at a respective hole 8.

The ducts 12 are arranged in a receptacle that is formed at the protrusion 11 and is provided with protrusions 14 for containing the nozzles 13 at which the holes 8 are provided.

The axes C of the holes 8 are substantially horizontal and are distributed sequentially along a circuit path that substantially reproduces the profile of the seat ring 5.

The holes 8 are distributed one after the other so that the respective nozzles 13 are orientated in a same direction along said circuit path, so as to form, above the seat ring 5, a continuous flow of washing fluid.

In the illustrated embodiment, the circuit path is quadrangular; proximate to each one of the four corners there is a hole 8 that is orientated toward one of the two sides that are incident thereto, while two consecutive holes 8 are orientated toward two mutually adjacent distinct sides.

In this manner, each one of the four sides of the path is affected by the fluid that exits from a corresponding hole 8, as shown by the arrows F.

Conveniently, the washing fluid is constituted by a mixture of water and disinfectant contained in a separate tank 15; the mixture is sent to the ducts 12 by means of a circuit that is not shown.

To the rear of the upper body 10 there are slots 16 for the passage of the ducts 12.

The upper part 6 furthermore comprises means for feeding the drying air, which are constituted by two rear channels 17 in which the inlet end is suitable to be associated with the outlet of respective electric fans 18 when the lid 2 is closed (FIG. 1) and the outlet end leads into the annular chamber for air distribution.

Advantageously, the transverse cross-section of the channels 17 gradually decreases from the inlet end toward the outlet end; this generates a vortical motion that facilitates the distribution of the air inside the chamber and its exit from the openings 9.

The channels 17 are delimited by the rear portion 19 of the lower body 7, which is advantageously inclined, and by the inner surface B of the upper body 10.

The openings 9 are shaped like substantially horizontal elongated slots that are distributed along an annular perimeter formed by the protrusion 11.

Two additional exit holes 20 for the washing fluid are provided to the rear of the seat ring 5 on the inner surface A of the lower part 4 of the lid 2 and are arranged horizontally and mutually opposite; each one of said holes is provided with a respective additional nozzle 21.

A hose 22, connected to the same circuit that feeds the ducts 12, feeds the washing fluid to the additional nozzles 21.

The fluid dispensed by the additional nozzles 21 washes the region to the rear of the ring 5, said region being conveniently inclined downward to facilitate the discharge of said fluid into the bowl 3.

Moreover, the lower part 4 is provided with lower sprayers 23, which before every use of the toilet W spray onto the inner surface of the bowl 3 the water fed by a hose 24 in order to facilitate the sliding of the user's evacuations toward the discharge pipes and prevent them from forming deposits.

Conveniently, on the inner surface A of the lower part 4 there are means for anchoring the seat ring 5 that are constituted by male elements 25 that interlock in corresponding female holes 26 formed in the lower surface of the seat ring 5.

The lower part 5 is provided, at the rear, with lugs 27 in which there are seats 28 for the insertion of a pivot for the articulation of a fork 29 that protrudes to the rear of the upper body 10 of the upper part 6.

A sensor 30 is arranged proximate to the lugs 27.

The device 1 furthermore comprises a column 31 that is suitable to be fixed to the wall to the rear of the toilet W and internally accommodates: the tank 15, a cistern 32 for the flushing water, the circuits for feeding the water and the washing fluid, and a linear actuator 33 for the automatic lifting and lowering of the upper part 6, the telescopic stem of said actuator being pivoted to the fork 29.

A display 34 (visual display screen) indicates the status of the device 1, warning of the beginning and the end of the washing cycle.

Finally, on the column 31 there are sensing means 35 and 36 for sensing the presence of a user; said sensing means are constituted by a radar with a broad detection range, suitable to detect the presence of a user both when he is moving and when he is in substantially static conditions for using the toilet W; the sensing means 35 and 36 are associated with a control unit 37 for controlling and driving the device 1.

Advantageously, the tank 15 is constituted by a canister that is supported detachably so that it can be replaced with another canister full of disinfectant when the disinfectant contained therein is depleted.

The operation of the invention is as follows:

The sensing means 35 and 36 detect the presence of a user proximate to the toilet W; while the lid 2 is closed, the sprayers 23 spray the water onto the inner surface of the bowl 3 and then the actuator 33 lifts the upper part 6, making the ring 5 available to the user.

The sensing means 35 and 36 ensure that the upper part 6 is kept in the raised configuration throughout the period of use of the toilet W by the user.

When the user, after ending his use of the toilet W, moves away from it, moving out of the detection range of the sensing means 35 and 36, the actuator 33 lowers the upper part 6 of the lid 2.

The cycle for washing the seat ring 5 is started automatically; the fluid sprayed by the nozzles 13 and by the additional nozzles 21 washes the seat ring 5 and the region behind it; then the water contained in the cistern 32 is discharged to flush the bowl 3, and finally the electric fans 18, by means of the channels 17, send the air into the annular distribution chamber, from which it exits from the openings 9 to strike the washed seat ring 5 in order to dry it.

The toilet W is thus clean and the seat ring 5 is disinfected and dry, ready for subsequent use.

In practice it has been found that the described invention achieves the intended aim and object.

The improved automatic device for washing the toilet seat ring according to the present invention in fact allows to optimize both the washing and the drying of the seat ring, protecting the user from dangers of contagion of infectious diseases and transmission of mycoses.

The possibility to replace the washing fluid containment tank allows to eliminate awkward top-up operations.

Moreover, the device according to the invention is structurally and constructively simple and can be installed and removed easily even on existing toilets.

The invention thus conceived is susceptible of numerous modifications and variations, all of which are within the scope of the inventive concept.

All the details may furthermore be replaced with other technically equivalent ones.

In practice, the materials used, as well as the shapes and dimensions, may be any according to the requirements without thereby abandoning the scope of the protection of the claims that follow.

The disclosures in Italian Patent Application No. MO2001A000180 from which this application claims priority are incorporated herein by reference.

What is claimed is:

1. An automatic device for washing a toilet seat ring of a toilet bowl having an upper rim, comprising a lid divided into two parts, a lower part, adapted to be fixed to the upper rim of the toilet bowl and having an inner surface upon which the toilet seat ring rests, and an upper part adapted to be superimposed hermetically on said lower part, with said upper part being angularly liftable with respect to the lower part and comprising: a box-like structure with a bottom; exit holes provided on said bottom for delivering a fluid for washing the toilet seat ring; exit openings for delivering air for drying the seat ring after washing; fluid feeding means for feeding the washing fluid to said holes and air feeding means for feeding the air to said opening, said holes having respective axes thereof and being distributed sequentially one after the other with the axes being horizontal and orientated in a same direction along a circuit path so that the fluid that exits from said holes being suitable produces a continuous flow adapted to strike said seat ring, said circuit path being substantially quadrangular and having four sides and corners thereof, and everyone of said holes being proximate to one at each one of said corners of said quadrangular path with the axis thereof orientated toward one of two sides that are incident to a corner, where the respective holes lies, each one of the four sides of the path being struck by the washing fluid that exits from a corresponding hole.

2. The device of claim 1, wherein said fluid feeding means comprise ducts arranged inside said box-like structure, said ducts being fed with said fluid and being provided with dispensing nozzles, arranged each respectively, at one of said holes.

3. The device of claim 2, wherein said box-like structure comprises an air distribution chamber, provided with said openings, which are shaped, as elongated slot and are arranged horizontally.

4. The device of claim 3, further comprising fans, said air feeding means comprising channels having an inlet end connectable to said fans and an outlet end connectable with amid air distribution chamber, said channels having a transverse cross-section of which decreases gradually from said inlet end to said outlet end.

5. The device of claim 4, wherein said box-like structure comprises a lower body and an upper body, said lower body comprising a lower annular protrusion, at which said holes and said opening are formed, said air distribution chamber being formed between said annular protrusion and an internal surface of said upper body.

6. The device of claim 5, wherein said annular protrusion comprises a receptacle for accommodating said ducts fed with the washing fluid, said receptacle being provided with protrusions far containing said dispensing nozzles, said holes being formed at said protrusions.

7. The device of claim 5, wherein said lower body comprises an inclined rear portion which forms, in combination with said upper body, said channels with decreasing transverse cross-section.

8. The device of claim 7, comprising additional exit holes for said washing fluid, which are formed in said inner surface of the lower part of said lid and are arranged to a rear region of said scat ring, said lower part of the lid comprising interlocking anchoring means for anchoring said seat ring and lower sprayers, said lower sprayers being fed with a liquid, such as water, and are arranged so as to spray said liquid onto an internal surface of said bowl.

9. The device of claim 8, comprising a linear actuator with a telescopic stern, said stem being pivoted to said upper part of the lid for lowering and lifting the upper part with respect to said lower part.

10. The device of claim 1 comprising sensing means for sensing presence of a user, being any of a radar and a motion sensor, said sensing means being provided so as to detect presence of a user in movement and in substantially static condition, while using the toilet.

* * * * *